US005766422A

United States Patent [19]

Crouse

[11] Patent Number: 5,766,422

[45] Date of Patent: Jun. 16, 1998

[54] LIGHTWEIGHT HIGH TEMPERATURE PRESSING

[75] Inventor: Jere W. Crouse, Beloit, Wis.

[73] Assignee: Beloit Technologies, Inc., Wilmington, Del.

[21] Appl. No.: 692,025

[22] Filed: Aug. 1, 1996

[51] Int. Cl.[6] ..... D21F 3/04

[52] U.S. Cl. ..... 162/358.5; 162/359.1; 162/360.2; 162/360.3

[58] Field of Search ..... 162/358.3, 360.2, 162/360.3, 359.1, 358.5

[56] References Cited

U.S. PATENT DOCUMENTS

| | | | |
|---|---|---|---|
| 3,198,695 | 8/1965 | Justus | 162/359.1 |
| 3,861,997 | 1/1975 | Ely | 162/360 |
| 4,075,056 | 2/1978 | Ely et al. | 162/305 |
| 4,086,131 | 4/1978 | Rempel et al. | 162/203 |
| 4,197,158 | 4/1980 | Johnson | 162/305 |
| 4,257,844 | 3/1981 | Schmitt et al. | 162/305 |
| 4,483,745 | 11/1984 | Wicks et al. | 162/205 |
| 4,556,451 | 12/1985 | Ely | 162/205 |
| 4,561,939 | 12/1985 | Justus | 162/360.1 |
| 4,704,192 | 11/1987 | Cronin | 162/360.1 |
| 4,973,384 | 11/1990 | Crouse et al. | 162/359 |
| 4,976,820 | 12/1990 | Laapotti | 162/360.3 |
| 5,047,122 | 9/1991 | Crouse et al. | 162/206 |
| 5,240,563 | 8/1993 | Karvinen et al. | 162/274 |
| 5,256,257 | 10/1993 | Schiel | 162/360.3 |
| 5,269,885 | 12/1993 | Tavi | 162/358.1 |
| 5,308,450 | 5/1994 | Braun et al. | 162/360.2 |
| 5,368,697 | 11/1994 | Steiner et al. | 162/360.2 |
| 5,439,559 | 8/1995 | Crouse | 162/358.5 |
| 5,500,092 | 3/1996 | Schiel | 162/358.3 |
| 5,593,547 | 1/1997 | Pisinger | 162/360.3 |

FOREIGN PATENT DOCUMENTS

| | | | |
|---|---|---|---|
| 0 547 816 A1 | 6/1993 | European Pat. Off. . | |
| 657597 | 6/1995 | European Pat. Off. | 162/358.3 |
| 16821 | 6/1995 | WIPO | 162/358.3 |

*Primary Examiner*—Karen M. Hastings

*Attorney, Agent, or Firm*—Dirk J. Veneman; Raymond W. Campbell; David J. Archer

[57] ABSTRACT

The press section of a papermaking machine has two conventional presses followed by two or three presses including one heated Extended Nip press thereby allowing control of the two-sidedness of the web by balancing the temperature and pressure of the Extended Nip Press with the pressure and temperature of the additional presses to form a one-sided sheet. The use of smooth high temperature press felts can aid in the reduction of two-sidedness of the formed web. The dryer section may alternatively add a fifth press utilizing the first dryer roll as the backing roll, two Extended Nip presses, a heated Extended Nip press followed by a heated conventional press, or a heated Extended Nip press in the third pressing position followed by a conventional heated press utilizing the first dryer as the backing roll.

14 Claims, 5 Drawing Sheets

LIGHTWEIGHT HIGH TEMPERATURE PRESSING

FIELD OF THE INVENTION

The present invention relates to paper machine pressing sections in general and to pressing sections for pressing lightweight paper grades in particular.

BACKGROUND OF THE INVENTION

Paper is made as a continuous web on a papermaking machine. The machine has a wet end where papermaking stock, composed of over 99 percent water is fed onto a moving wire screen known as a Fourdrinier. The water drains through the screen leaving a thin sheet of fibers forming the web of paper. The web as formed still contains over 80 percent water. From the forming screen or wire the web is moved through a pressing section where water is pressed from the web. Upon leaving the pressing section, the web of paper is still composed of approximately 60 percent water. The pressed web is then dried on a series of steam heated drums before being wound onto a reel at the dry end of the papermaking machine.

In forming a paper web it is important, particularly in the lighter weight grades of paper used for printing newspapers and magazines, that both sides of the sheet of paper formed be essentially identical. Paper which has similar attributes on both surfaces can readily be printed on both sides with a uniform result. Where both sides of a paper sheet are essentially identical the paper is referred to as one-sided. Two-sided paper, where the properties of each side differ significantly, is undesirable and can result from more water being removed from one side of the web than the other in the pressing section. Pressing sections are therefore generally designed to maintain one-sidedness in the web of paper being formed.

Drying paper requires more energy than pressing the water from the paper web. On high speed modern papermaking machines where the web may move through the machine in excess of 6,000 feet per minute, the length of the dryer section can become excessively long in order to dry the rapidly moving web. This has led to the use of high temperature press rolls. High temperature press rolls of either the conventional or Extended Nip® type manufactured by Beloit Corporation, can increase the dryness of the paper, significantly reducing the amount of drying required. However, the high temperatures and pressures required to achieve this can result in the production of two sided paper. It is known that if the pressure in the heated nip is reduced the two-sidedness of the paper will be lessened. However, lowering nip pressure results in less effectiveness in removing water from the web.

What is needed is a pressing section of a paper machine which can increase pressed dryness significantly without increasing two-sidedness of the formed web.

SUMMARY OF THE INVENTION

The press section of a papermaking machine of this invention is used in the production of lightweight paper of 100 grams per square meter or less. A conventional press section for lightweight paper grades utilizes two conventional presses which increase the fiber content to between 35 percent and 42 percent dry weight. These conventional presses are followed by a third press used to increase dryness. The third press, however, can induce two-sidedness in the web being formed. The press section of this invention replaces the third press with two or three presses including one heated Extended Nip press. The Extended Nip press increases the dry weight of the web about 20 percent and improves sheet strength about 30 percent. The availability of an additional one or two presses following the conventional pressing section allows control of the two-sidedness of the web by balancing the temperature and pressure of the Extended Nip Press with the pressure and temperature of the additional one or two presses to produce a one-sided sheet. The use of certain smooth high temperature press felts such as BXC5 type felt, which is constructed of nomax fiber and is available from Albany International, can aid in the reduction of two-sidedness of the formed web. A first embodiment utilizes a conventional third press followed a heated Extended Nip press. A second embodiment adds a fifth press which utilizes the first dryer roll as the backing roll to give greater control over the two-sidedness of the web. A third embodiment uses two Extended Nip presses which press opposite sides of the web. The temperature and pressures of the two Extended Nip presses can be controlled to produce a high strength, increased dryness, web which is one-sided. A fourth embodiment utilizes a heated Extended Nip press followed by a heated conventional press to achieve high dryness and one-sidedness from the formed web. A fifth embodiment which is particularly useful for very lightweight paper grades employs a heated Extended Nip press in the third pressing position followed by a conventional unheated press utilizing the first dryer as the backing roll.

It is a feature of the present invention to provide a pressing section for lightweight paper grades which produces increased dryness and sheet strength while minimizing web two-sidedness.

It is another feature of the present invention to provide a pressing section for lightweight paper grades which improves runnablity.

It is a further feature of the present invention to provide a pressing section for lightweight paper grades which improves web strength.

It is also a feature of the present invention to provide a pressing section for lightweight paper grades which can be run at high speeds.

Further objects, features and advantages of the invention will be apparent from the following detailed description when taken in conjunction with the accompanying drawings.

DESCRIPTION OF THE PREFERRED EMBODIMENT

Figure 1:
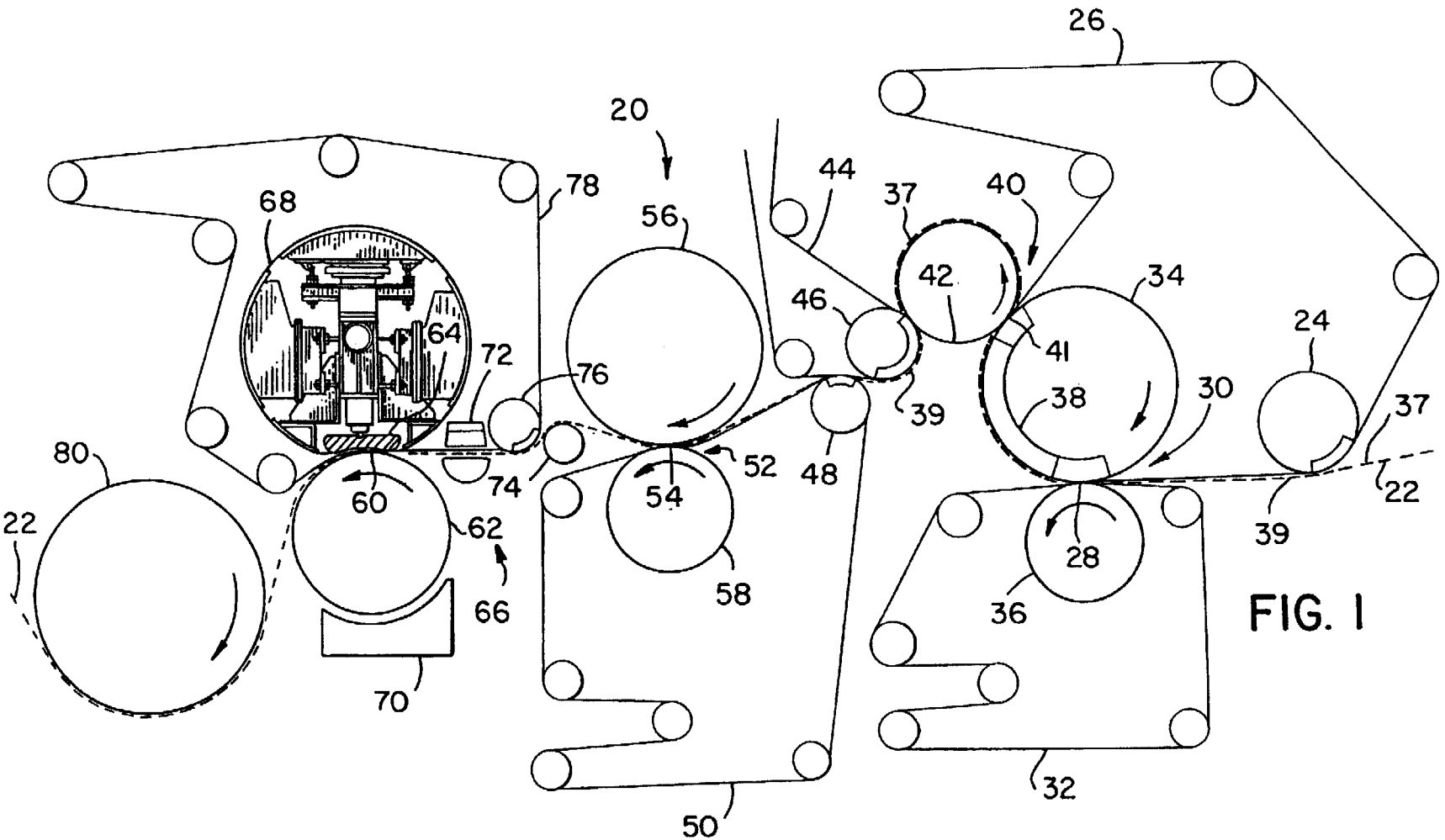
FIG. 1 is a schematic view of the lightweight paper pressing section of this invention.

Referring more particularly to FIGS. 1–5 wherein like numbers refer to similar parts, a pressing section 20 is shown in FIG. 1. The pressing section 20 is composed of four distinct presses whereas prior art pressing sections have typically had three presses. A web 22 enters the pressing section 20 on the right side of FIG. 1. The web first progresses through an initial pressing run comprised of two presses. A vacuum pickup roll 24 transfers the web 22 from a forming wire (not shown) onto an upper felt 26. A lower felt 32 is brought into engagement with the web 22. The web 22 then enters a nip 28 formed by a first press 30 while positioned between the upper felt 26 and the lower felt 32. The nip 28 is formed between a vented press roll 34 and a backing roll 36. The vented press roll 34 has a three part gland 38 which aids in removing water from the web 22 as it passes through the first press 30. The gland 38 also assures that the web remains with the upper felt as it is turned around the vented roll 34 and aids the transfer of the web 22 onto a second or central backing roll 42. A second press 40 forms a nip 41 between the vented roll 34 and the center backing roll 42. The web 22 leaves the second press 40 with a dry weight of about 35 to 42 percent fiber.

It is desirable in general, and with lightweight paper grades of less than 100 grams in particular, that both sides of the web have the same surface finish and surface properties. This identity between the two sides of a paper web is referred to as one-sidedness, the opposite of two-sidedness. Two-sidedness is caused by each side of a web being subjected to different processing. In particular if the amount of water removed from each side of the web is not the same this can produce two-sidedness. In FIG. 1 the web 22 is subjected to dewatering in the first nip 28 supported between the upper felt 26 and the lower felt 32 which are chosen so the amount of water removed from the top side 37 and the bottom side 39 side of the web 22 is substantially the same. Pressing the web 22 in the second nip 41 where the top side 37 of the web is backed by the upper felt 26 produces a two-sided web.

From the second nip 41 on the center backing roll 42 the web 22 wraps around the roll 42 and is removed onto a transfer felt 44 by a vacuum roll 46. A second transfer roll 48 transfers the web 22 from the transfer felt 44 to a second bottom felt 50 which transports the web 22 through a third press 52. The third press 52 corrects the two-sidedness of the web 22 because the second bottom felt 50 is positioned against the bottom side 39 of the web 22 as it passes through a nip 54 formed by third press roll 56 and a backing roll 58.

The three presses described above or just the first two presses described above are present in many existing press sections, for example pressing sections available from Beloit Corporation include the Bi Nip™, and Twinver™ plus 3rd or their counterparts for higher speeds, the Bi Vent™ plus 3rd or Tri Vent. The object of the pressing section 20 of FIG. 1 is to increase the dryness, as much as twenty percent or more, and to improve the strength of the web formed for lightweight grades of paper. The initial pressing accomplished by the first two presses may be accomplished in certain circumstances with a single press of adequate capacity.

To achieve a dryer and stronger web 22, the pressing section 20 of FIG. 1 employs a fourth nip 60 formed between a heated backing roll 62 and a shoe 64. The fourth press 66 forms a heated pressing means and is of the type referred to as an Extended Nip press. A blanket 68 surrounds a shoe 64 and a lubricating film of fluid supports the blanket 68 as it passes over the shoe 64. The significantly longer dwell time within the Extended Nip press together with heating from a roll heater 70 and optionally from a steam shower 72 produces significantly increased web dryness and strength. The web strength in turn improves the runnablity of the web 22 by reducing paper breaks and the costs associated therewith.

The web 22 is separated from the bottom felt 50 as it leaves the 3rd nip 54 and passes over a support roll 74. From the support roll 74 a vacuum pickup roll 76 transfers the web 22 onto a second top felt 78 where the top side 37 of the web 22 is positioned against the felt 78. The fourth press 66 has the potential of introducing two-sidedness to the web 22 in the process of significantly increasing the web dryness. This can be controlled by utilizing a smooth Teflon felt or even a fine denier felt such as R40 or BXC5 type felt which is constructed of heat resistant fiber. These felts are generally available from Albany International Press Felt Fabrics Division, a division of Albany International, P.O. Box 1109, Albany, N.Y. 12201–1109. One advantageous smooth teflon felt is disclosed in Albany International's European patent application 92311110.8, Publication number 0547816 A1.

The nip load in the 3rd Press 52 and the temperature of the press roll 62 can also be varied to achieve better one-sidedness. After leaving the fourth press 66 the web 22 is wrapped around the first dryer roll 80 where it enters the dryer section.

Figure 2:
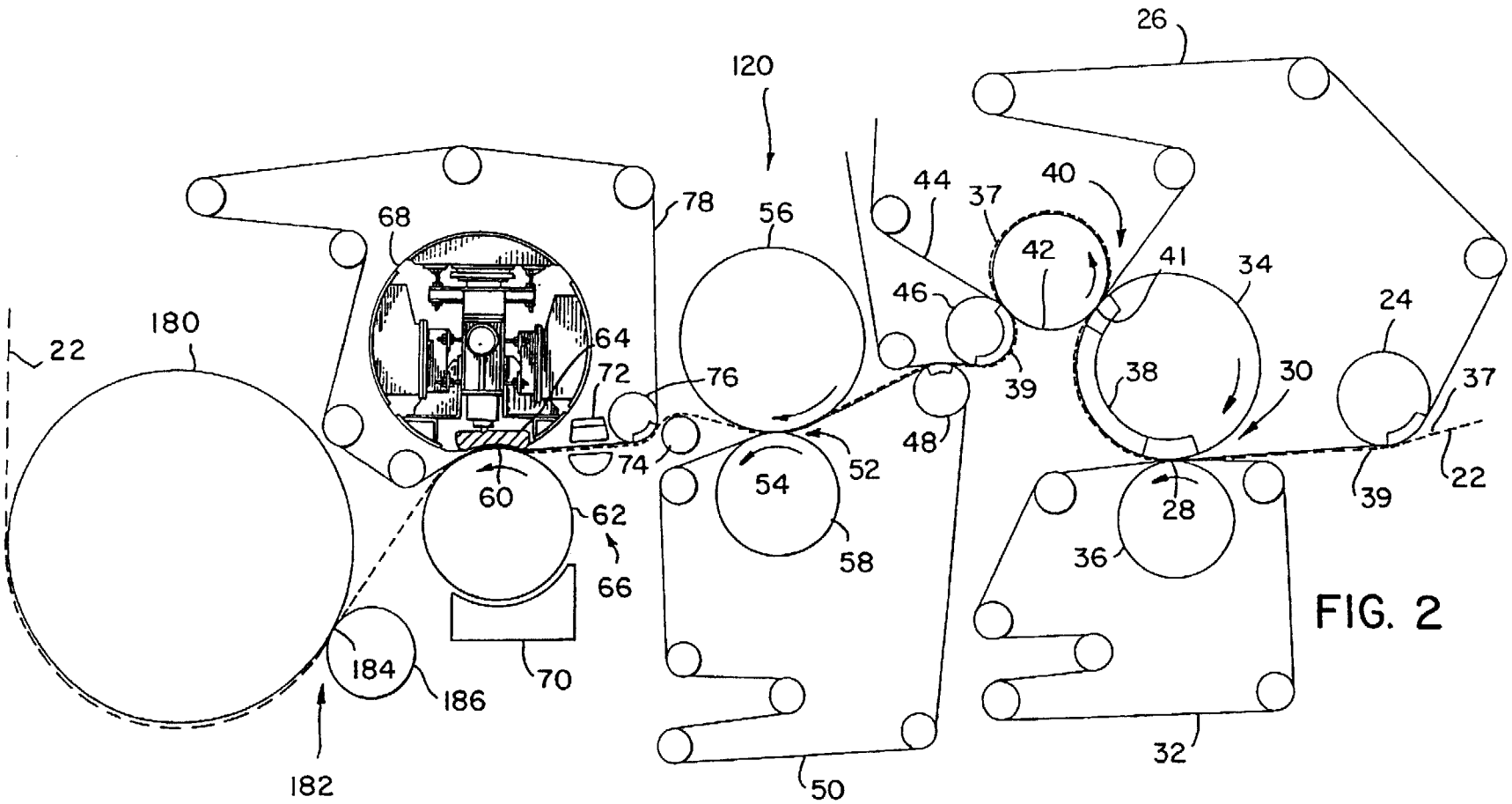
FIG. 2 is a schematic view of the lightweight paper pressing section of FIG. 1 with an additional press.

An alternative pressing section 120 of this invention is shown in FIG. 2. The pressing section 120 is similar to the pressing section 20, but employs a fifth press 182 which has a nip 184 formed between a backing roll 186 and a dryer roll 180. In the press section 120 the web 22 is directed around the bottom of the dryer roll 180 thus bringing the top side 37 into engagement with the dryer roll 180. The fifth press 182 gives an additional nip which can be adjusted to improve one-sidedness of the web 22.

Figure 3:
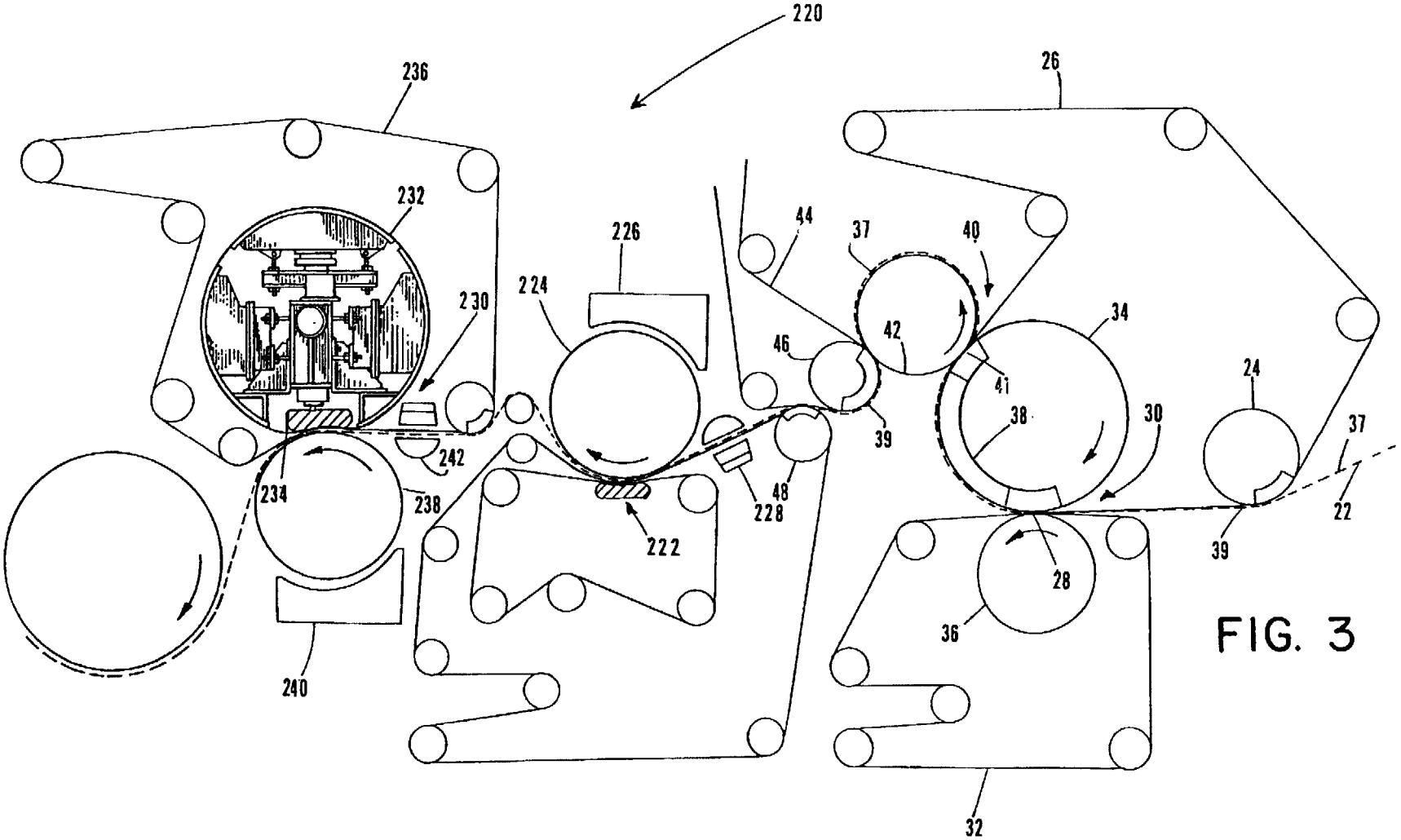
FIG. 3 is a schematic view of an alternative embodiment pressing section of this invention.

FIG. 3 shows an alternative embodiment pressing section 220 which has two heated Extended Nip presses following the first and second presses 30, 40. The first Extended Nip press 222 employs a heated press roll 224 which is heated by a heater 226 which may be of the induction type or a radiant type. The web can also be preheated by a steam shower 228. The first Extended Nip press 222 is in the normal position and can employ an open blanket type press as shown in FIG. 3. It can also employ a closed blanket type. The second Extended Nip press 230 is in the inverted position and thus must be of the closed blanket type.

The first and second Extended Nip presses 222, 230 engage opposite sides of the web 22 and thus the pressure, temperature and nip residence time can be adjusted to produce one-sided lightweight paper. The second press 230 has a closed blanket 232 and a shoe 234 which presses a top felt 236 against the web 22 and a press roll 238. The press roll 238 is heated by a heater 240 similar to the heater 226 employed with the press roll 224. A second steam shower 242 can preheat the web 22 as it enters the second nip 230. The use of two Extended Nip presses, one on each side of the web, gives greater control over the one-sidedness of the web 22.

Figure 4:
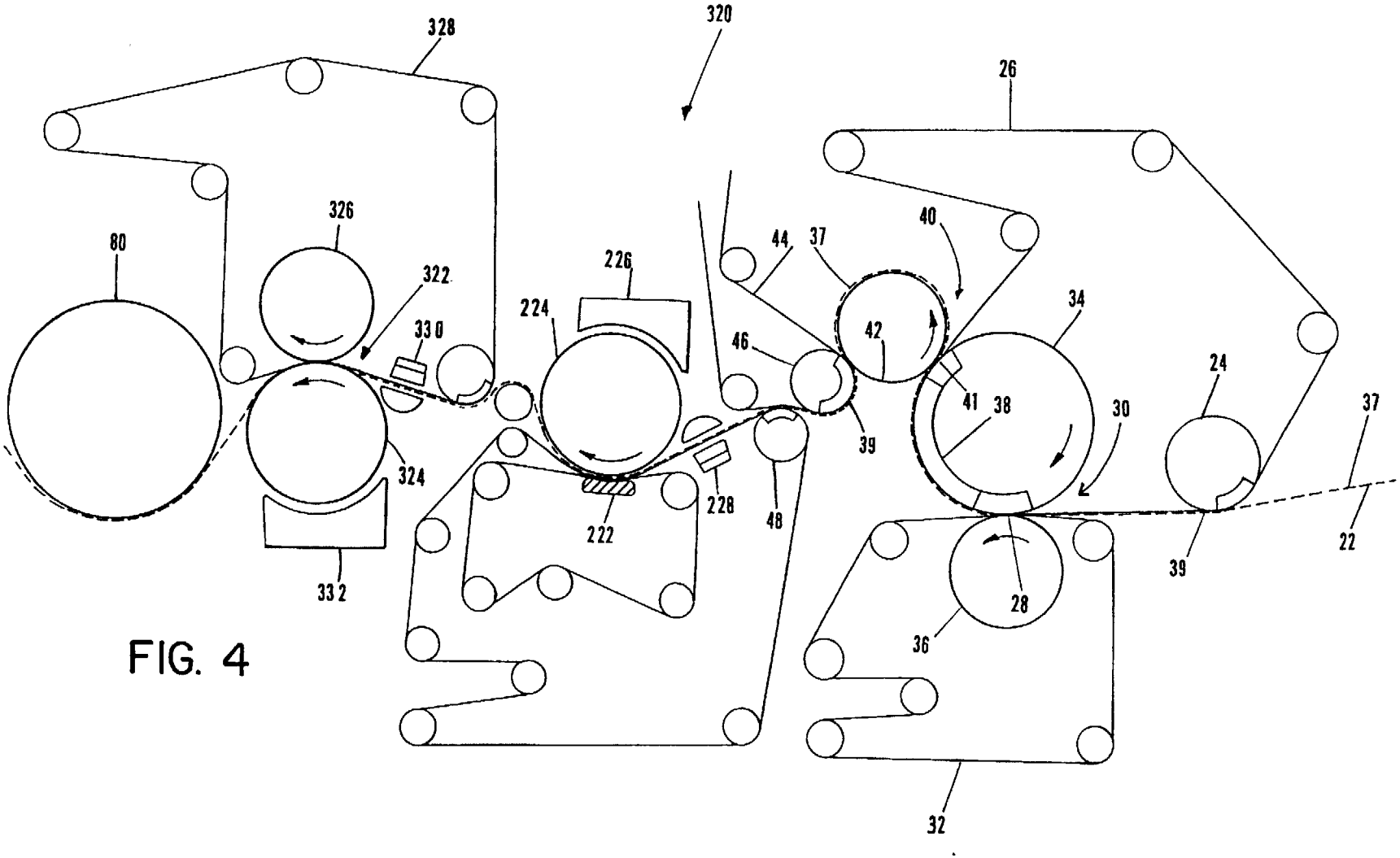
FIG. 4 is a schematic view of yet another embodiment of the pressing section of this invention.

A modification of the pressing section 220 is shown in FIG. 4 where a pressing section 320 has a conventional heated press 322 in the fourth pressing position. A conventional press 322 is considerably less costly and has generally lower maintenance requirement as compared to an Extended Nip press. Therefore if a conventional press is sufficient to achieve the desired web properties it will be the preferred approach. A test was run where the press roll 224 was heated to between 300 and 400 degrees Fahrenheit and where the press roll 324 was heated to between 72 and 300 degrees Fahrenheit with satisfactory production of one-sided paper. The conventional press 322 has a backing roll 326 and an upper felt 328. The web 22 can be preheated by a steam shower 330, and the press roll 324 is heated by an induction or radiant heater 332.

Figure 5:
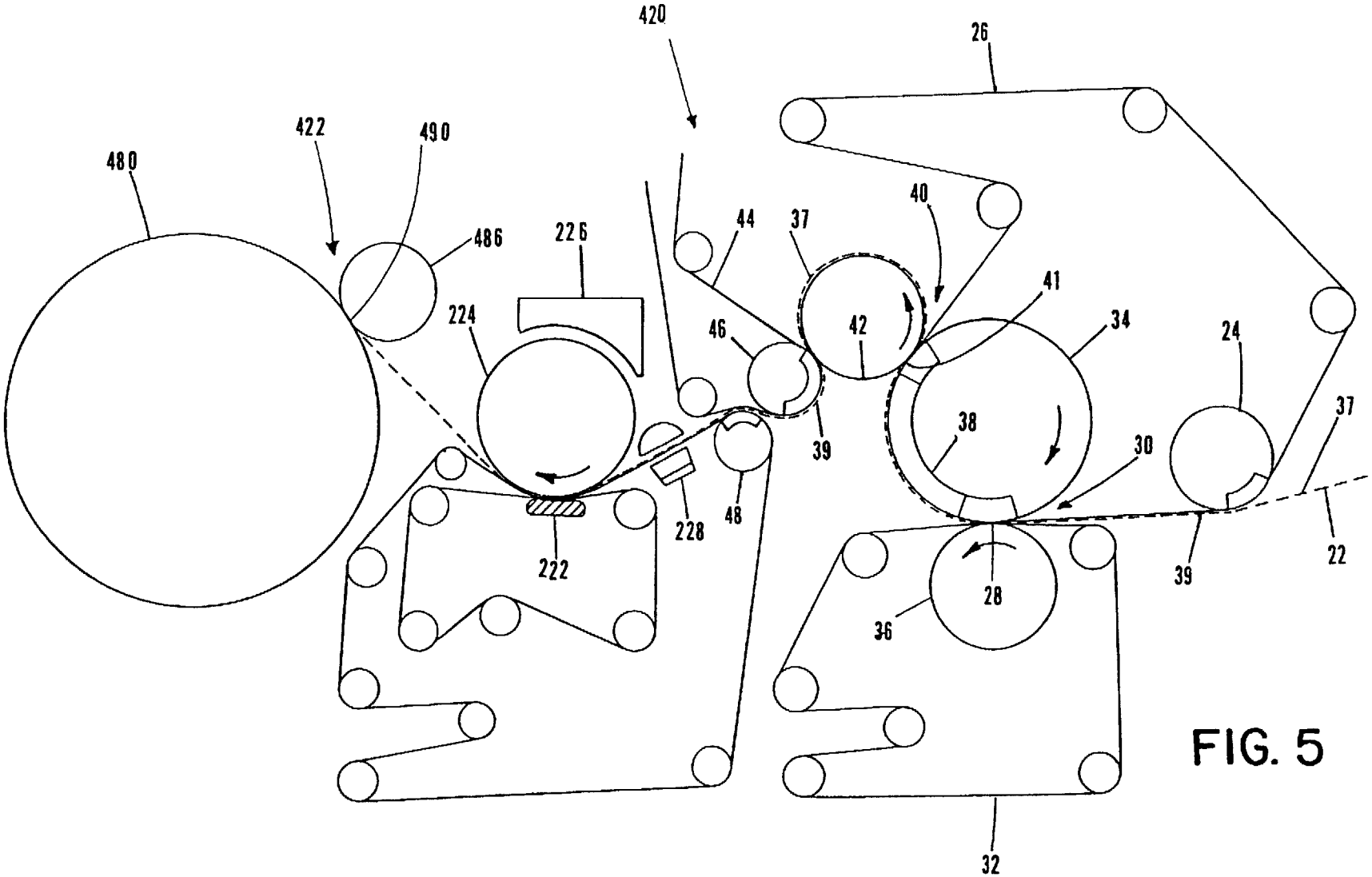
FIG. 5 is a schematic view of a yet further embodiment of the pressing section of this invention for very lightweight paper grades.

For very lightweight grades of paper well under 100 grams per square meter a pressing section 420 as shown in FIG. 5 may be the optimal approach. The pressing section 420 of FIG. 5 has a third press 222 similar to the third presses in FIGS. 3 and 4. The fourth press 422 is formed by a first dryer roll 480 and a backing roll 486 which define a fourth nip 490. The fourth press 422 is similar to the press 182 of FIG. 2 except because there is one less press the bottom side 39 of the web 22 is brought into engagement with the dryer roll 480 by positioning the backing roll 486 on the upper half of the dryer roll 480.

It should be understood that where open blanket Extended Nip press are shown, closed Extended Nip presses could be used.

It also should be understood that a conventional roll has a special covered metal press roll and a backing roll which may have some compliance but is in general limited to a nip of less than one inch or so. Compliant backing rolls have a limited nip extending ability particular at higher speeds as deflection of the backing roll can produce unacceptable heating in the backing roll.

It should also be understood that the press rolls disclosed herein may be cast steel rolls with a coating. The press rolls also may advantageously be coated with Armacor and possibly chromeplate, Boron nitrate or cermets—which are metal ceramic coatings. Chromlon may also be a suitable press roll coating. Armacor is available from Amorphous Metal Technologies, Inc., 1005 Meuirlands, Suite 5, Irvine, Calif. 92718. A typical metal coating material, Armacor C, contains forty percent chrome, thirty percent nickel, five percent boron, four percent molybdenum, four percent copper, and three percent silicon, with the balance being iron.

The preferred material is comprised of fourteen to sixteen percent molybdenum, twenty-eight to thirty percent nickel, thirty to thirty-four percent chrome, 1.2 to 1.8 percent silicon, 4 to 4.5 percent boron, 0.2 percent or less carbon, and copper between 3 and 3.8 percent with the balance being iron.

To date, alloys containing four percent molybdenum, seven percent molybdenum, fourteen percent molybdenum, and seventy percent molybdenum have been tested. Of these alloys the fourteen percent molybdenum and seventy percent molybdenum alloys have the best release characteristics with the fourteen percent molybdenum having better thermal conductivity and so better heat transfer properties. Heat transfer rates are important because it is the amount of heat which can be transferred to the paper web as it transits the nip which determines whether high speed drying can take place.

It is also important to recognize that roll coating alloys herein disclosed could be used to form ceramic metal coatings known as CerMets. Thus, the metal alloys together with ZrO2, Al203, Moly-Chromium-Alumina, Chromium-Alumina, SiO3, BeO, MgO, CaO, or ThO2 may by combined by flame spraying onto the roll to form coatings which bring together the release characteristics of the molybdenum-containing alloys and the release characteristics of ceramics. In particular, experiments performed have shown that zirconium oxide and the aluminum oxide have excellent release characteristics. While the ceramics provide excellent release characteristics, their heat transfer characteristics are not as high and hence not as desirable. Thus, combinations of the two, particularly combinations containing fifty percent or more metal, have desirable characteristics.

It is understood that the invention is not limited to the particular construction and arrangement of parts herein illustrated and described, but embraces such modified forms thereof as come within the scope of the following claims.

I claim:

1. A pressing section of a paper making machine for pressing a paper web having a first side and a second side and having a dry weight of less than one-hundred grams per square meter, the pressing section having only a single heated Extended Nip press and an initial pressing run having at least one but no more than two press nips, the web leaving said initial pressing run with a solid content between thirty-five and forty-two percent solid content, wherein the improvement comprises:

a third press in web receiving relation with the initial pressing run, wherein the third press has a press roll and a backing roll, and a first felt supporting the web through a nip formed between the press roll and the backing roll, and wherein the first side of the paper web engages the press roll;

a fourth press being the single heated Extended Nip press having a shoe urging a means for achieving one-sidedness in the web against a fourth press roll, said means comprising a felt, wherein the second side of the paper web engages the fourth press roll at a fourth nip, the pressing section thereby producing a web having nearly identical surface characteristics on the first and second sides; and a fifth press following the fourth press wherein the fifth press is defined by a first dryer roll which is engaged at a nip with a further backing roll and the web is in direct contact with the dryer and the further backing roll.

2. The pressing section of claim 1 wherein the fourth press is heated by a steam shower which heats the felt and the web as it enters the fourth nip.

3. The pressing section of claim 1 further comprising a steam shower directed onto the web immediately preceding the third press.

4. The pressing section of claim 1 wherein the felt of the fourth press is fabricated of a heat resistant fiber.

5. The pressing section of claim 1 wherein the felt of the fourth press is fabricated of teflon mixed with a heat resistant fiber.

6. A pressing section in a papermaking machine for pressing a paper web having a first side and a second side the web having a dry weight of less than one-hundred grams per square meter, the pressing section having only a single heated Extended Nip press and an initial pressing run having at least one but no more than two press nips, the web leaving sad initial pressing run with a solid content between thirty-five and forty-two percent, wherein the improvement comprises:

a third press being the heated Extended Nip press having a shoe urging a felt and the first side of the web against a third press roll which engages the first side of the web; and a fourth press having a fourth press roll and a heated backing roll, and a felt supporting the web through a nip formed between the fourth press roll and the backing roll, the second side of the paper engaging the fourth press roll, to produce a web with first and second sides nearly identical; and a fifth press following the fourth press wherein the fifth press is defined by a first dryer roll which is engaged at a nip with a further backing roll and the web is in direct contact with the first dryer roll and the further backing roll.

7. A high temperature pressing apparatus for pressing lightweight paper grades having finished weights of less than about 100 grams per square meter, said apparatus comprising:

a pick-up felt extending as an endless loop for picking up the paper web;

a vented press roll disposed within a loop defined by said pick-up felt such that said pick-up felt is guided by and around said vented press roll;

a press felt cooperating with said pick-up felt such that the paper is guided between said pick-up felt and said press felt;

a backing roll cooperating with said vented press roll such that said pick-up felt and said press felt extend through a first nip defined between said vented roll and said first backing roll;

a further backing roll cooperating with said vented roll for defining therebetween a second nip disposed downstream relative to said first nip, the paper being supported and guided by said pick-up felt from said first nip to said second nip while said pick-up felt extends around said vented roll;

a transfer felt cooperating with said second backing roll for transferring the web from said second backing roll;

a suction roll disposed within a loop defined by said transfer felt, said suction roll cooperating with said second backing roll for transferring the paper from said second backing roll to said transfer felt;

a further press felt cooperating with said transfer felt such that the paper web is transferred from said transfer felt onto said further press felt;

a further pick-up roll disposed within a loop defined by said further press felt, the arrangement being such that said further press felt is disposed between said transfer felt and said further pick-up roll;

a plain roll disposed downstream relative to said further pick-up roll and on the opposite side of said further press felt relative to said further pick-up roll such that the paper supported by said further press felt is guided between and in contact with said further press felt and said plain roll;

a press member cooperating with said plain roll for defining therebetween a third nip for the passage therethrough of the paper, the arrangement being such that the paper is disposed between said plain roll and said further press felt during passage through said third nip; and heated pressing means disposed downstream relative to said third nip for further heating and pressing of the paper, the arrangement being such that the resultant pressed paper attains substantially identical printable surface characteristics on both sides thereof.

8. The pressing apparatus of claim 7 wherein the heated pressing mean includes an Extended Nip press.

9. The pressing apparatus of claim 7 wherein the heated pressing means includes a smooth felt which passes through a heated nip, the smooth felt supporting the paper and facilitating production of substantially identical printable surface characteristics on both sides of the paper.

10. The pressing apparatus of claim 7 further comprising a first dryer roll disposed downstream relative to the heated pressing means forming a nip with a backing roll.

11. A high temperature pressing apparatus for pressing lightweight paper grades having finished weights of less than about 100 grams per square meter, said apparatus comprising:

a pick-up felt extending as an endless loop for picking up the paper web; a vented press roll disposed within a loop defined by said pick-up felt such that said pick-up felt is guided by and around said vented press roll;

a press felt cooperating with said pick-up felt such that the paper is guided between said pick-up felt and said press felt;

a backing roll cooperating with said vented press roll such that said pick-up felt and said press felt extend through a first nip defined between said vented roll and said first backing roll;

a further backing roll cooperating with said vented roll for defining therebetween a second nip disposed downstream relative to said first nip, the paper being supported and guided by said pick-up felt from said first nip to said second nip while said pick-up felt extends around said vented roll;

a transfer felt cooperating with said second backing roll for transferring the web from said second backing roll;

a suction roll disposed within a loop defined by said transfer felt, said suction roll cooperating with said second backing roll for transferring the paper from said second backing roll to said transfer felt;

a further press felt cooperating with said transfer felt such that the paper is transferred from said transfer felt onto said further press felt;

a further pick-up roll disposed within a loop defined by said further press felt, the arrangement being such that said further press felt is disposed between said transfer felt and said further pick-up roll;

a plain roll disposed downstream relative to said further pick-up roll and on the opposite side of said further press felt relative to said further pick-up roll such that the paper supported by said further press felt is guided between and in contact with said further press felt and said plain roll;

a third nip defined between said plain roll and a concave shoe, wherein the paper passes through the third nip, the arrangement being such that the paper is disposed between said plain roll and said further press felt during passage through said third nip; and heated pressing means disposed downstream relative to said third nip for further heating and pressing of the paper, the arrangement being such that the resultant pressed paper attains substantially identical printable surface characteristics on both sides thereof.

12. The pressing apparatus of claim 11 wherein the heated pressing means includes an Extended Nip press having a press roll and a concave shoe engaged against the press roll.

13. The pressing apparatus of claim 11 wherein the heated pressing means comprises:

a plain roll; and a press member cooperating with said plain roll.

14. The pressing apparatus of claim 11 wherein the heated pressing means comprises a first dryer roll forming a nip with a backing roll.

* * * * *